US005176200A

United States Patent [19]

Shinmura

[11] Patent Number: 5,176,200

[45] Date of Patent: Jan. 5, 1993

[54] METHOD OF GENERATING HEAT EXCHANGE

[75] Inventor: Toshiharu Shinmura, Isesaki, Japan

[73] Assignee: Sanden Corporation, Gunma, Japan

[21] Appl. No.: 793,012

[22] Filed: Nov. 15, 1991

Related U.S. Application Data

[62] Division of Ser. No. 513,623, Apr. 24, 1990, Pat. No. 5,086,835.

[30] Foreign Application Priority Data

Apr. 24, 1989 [JP] Japan ..... 1-46793[U]

[51] Int. Cl.[5] ..... F28F 9/26

[52] U.S. Cl. ..... 165/1; 165/144

[58] Field of Search ..... 165/1, 144, 145, 152; 123/41.01, 41.51

[56] References Cited

U.S. PATENT DOCUMENTS

| | | | |
|---|---|---|---|
| 2,124,291 | 7/1938 | Fleisher | 165/145 X |
| 2,184,657 | 12/1939 | Young | 165/145 |
| 2,229,266 | 1/1941 | Young | 165/145 |
| 2,237,903 | 4/1941 | Drake | 165/144 X |
| 2,327,491 | 8/1943 | Blais | 165/144 |
| 2,505,790 | 5/1950 | Panthofer | 165/140 |
| 2,512,560 | 6/1950 | Young | 165/144 X |
| 3,232,343 | 2/1966 | Lindstrand et al. | 165/148 |
| 3,763,953 | 10/1973 | Yoda et al. | 180/68.1 |
| 3,920,069 | 11/1975 | Mosier | 165/150 |
| 3,939,908 | 2/1976 | Chartet | 165/149 |
| 4,063,431 | 8/1976 | Dankowski | 62/239 |
| 4,137,982 | 2/1979 | Crews et al. | 165/67 X |
| 4,138,857 | 2/1979 | Dankowski | 62/239 |
| 4,190,105 | 2/1980 | Dankowski | 165/179 |
| 4,367,793 | 1/1983 | MacIntosh | 165/151 |
| 4,531,574 | 7/1985 | Hoch | 165/67 |
| 4,569,390 | 2/1986 | Knowlton et al. | 165/149 |
| 4,590,892 | 5/1986 | Nose et al. | 123/41.12 |
| 4,651,816 | 3/1992 | Struss et al. | 165/76 |

FOREIGN PATENT DOCUMENTS

| | | | |
|---|---|---|---|
| 0021651 | 4/1980 | European Pat. Off. . | |
| 2423440 | 5/1974 | Fed. Rep. of Germany . | |
| 2304832 | 8/1974 | Fed. Rep. of Germany | 165/144 |
| 662841 | 8/1929 | France | 165/144 |
| 1191160 | 2/1958 | France . | |
| 54-110519 | 8/1979 | Japan | 123/41.51 |
| 58-67918 | 4/1983 | Japan . | |
| 61-202084 | 9/1986 | Japan . | |
| 63-74970 | 4/1988 | Japan . | |
| 707593 | 4/1954 | United Kingdom | 123/41.51 |
| 2113819 | 1/1983 | United Kingdom . | |

*Primary Examiner*—Allen J. Flanigan
*Attorney, Agent, or Firm*—Baker & Botts

[57] ABSTRACT

A heat exchanger includes a plurality of integrally assembled heat-exchanger cores each comprising a pair of header pipes, a plurality of flat heat-transfer tubes and a plurality of fins. A heat medium flows from an inlet tube connected to one of the header pipes to an outlet tube connected to another one of the header pipes through the plurality of heat-exchanger cores communicating with one another. The heat-transfer area of the heat exchanger can be increased without increasing the diameters of its header pipes, to thereby increase the total heat-exchange ability of the heat exchanger.

4 Claims, 7 Drawing Sheets

METHOD OF GENERATING HEAT EXCHANGE

This is a divisional of copending patent application Ser. No. 07/513,623 filed Apr. 24, 1990, now U.S. Pat. No. 5,086,835.

BACKGROUND OF THE INVENTION

1. Field of the Invention

The present invention relates to a heat exchanger, and more particularly to a heat exchanger having a large heat-transfer area even in a limited space for installation of the heat exchanger.

2. Description of the Prior Art

FIGS. 14 and 15 show typycal conventional heat exchangers (which may, for example, be condensers) which require the heat exchange between a heat medium (for example, cooling medium) flowing in the heat exchangers and the air passing through the heat exchangers. In a heat exchanger 100 (condenser) shown in FIG. 14, a flat heat-transfer tube 101 extends in a serpentine form, and corrugate radiation fins 102 are disposed between the parallel portions of the serpentine tube. An inlet header pipe 103 is connected to one end of flat heat-transfer tube 101. An outlet header pipe 104 is connected to the other end of the flat heat-transfer tube. In a heat exchanger 200 (condenser) shown in FIG. 15, a plurality of flat, parallel heat-transfer tubes 201 are provided between a pair of parallel header pipes 202 and 203, and corrugate fins 204 are provided on the sides of the flat heat-transfer tubes. An inlet tube 205 is connected to header pipe 202 for introducing a cooling medium into the header pipe. An outlet tube 206 is connected to header pipe 203 for delivering the cooling medium out from the header pipe.

In any one of such conventional condensers, an increase of the heat-exchange ability (i.e., the condensation ability of the condenser) is required for reducing the energy consumption of a compressor provided in a refrigerating cycle. One method for increasing this ability is to increase the length of the condenser in its air flow direction, namely, in its thickness direction, to thereby increase the heat-transfer area thereof.

In the heat exchanger shown in FIG. 15, however, if the size in the thickness direction Z of flat heat-transfer tubes 201 of the heat exchanger is enlarged to increase its heat-exchange ability, under the condition in that the total width W is restricted within a limited value (for example, as illustrated by the broken line in FIG. 16), the air flowable area is reduced from A1 to A2 because the diameters of header pipes 202 and 203 also become correspondingly larger with the enlargement of the size of the flat heat-transfer tubes. Such a reduction of the air flowable area causes the heat-exchange ability of the heat exchanger to be greatly decreased. Therefore, even if the heat-transfer area of flat heat-transfer tubes 201 can be enlarged, the potential for increasing the total heat-exchange ability of the heat exchanger is small due to the decrease of the air flowable area.

Moreover, in the heat exchanger shown in FIG. 14 or 15, because the pipes 103 and 104 or tubes 205 and 206 must be positioned within respective small restricted areas, the degree of design freedom for the positions thereof is very small. Therefore, the design of pipes or tubes to be connected to pipes 103 and 104 or tubes 205 and 206 is also restricted in position.

SUMMARY OF THE INVENTION

Accordingly, it is an object of the present invention to provide a heat exchanger which can increase its heat-transfer area without increasing the diameters of its header pipes, and thereby increase the total heat-exchange ability of the heat exchanger.

Another object of the present invention is to provide a heat exchanger which has great design freedom with respect to the positions of its inlet tube and outlet tube.

To achieve these objects, a heat exchanger according to the present invention is herein provided. The heat exchanger comprises a plurality of heat-exchanger cores each having a pair of header pipes extending in parallel relation to each other, a plurality of flat heat-transfer tubes disposed between the pair of header pipes in parallel relation to one another and connected to an comunicating with the pair of header pipes at their end portions, and a plurality of fins provided on the sides of the flat heat-transfer tubes, wherein the plurality of heat-exchanger cores are integrally assembled in parallel relation to one another; means for connecting and communicating between one of the pair of header pipes of a heat-exchanger core of the plurality of heat-exchanger cores and one of the pair of header pipes of another heat-exchanger core of the plurality of heat-exchanger cores; an inlet tube for a heat medium connected to an communicating with one of the pair of header pipes of at least one of the plurality of heat-exchanger cores; and an outlet tube for the heat medium connected to and communicating with another one of the pair of header pipes of at least one of the plurality of heat-exchanger cores.

In the heat exchanger, a plurality of heat-exchanger cores are integrally assembled in parallel relation to one another. The connecting and communicating means communicates between a header pipe of one head-exchanger core and a header pipe of another heat-exchanger core. The heat medium flows from the inlet tube to the outlet tube through the heat-transfer tubes and header pipes of each heat exchanger core and the connecting and communicating means. Since a plurality of heat-exchanger cores are integrally assembled, the heat-transfer area of the heat exchanger can be increased substantially proportionally by the number of the heat-exchanger cores, even though each heat-exchanger core has substantially the same o similar size as a conventional single heat exchanger. Therefore, it is unnecessary to increase the diameter of the header pipes when the heat exchanger is designed, and the heat-exchange ability can be greatly increased.

Moreover, since the inlet tube and the outlet tube can be provided on different heat-exchanger cores, the positions of the tubes can be selected with a great degree of design freedom, almost independently from each other. For example, the inlet and outlet tubes can be disposed on the same side of the heat exchanger, on different sides of the heat exchanger, at the same height, or at different heights. Furthermore, the plurality of heat-exchanger cores can be substantially the same size or different sizes.

BRIEF DESCRIPTION OF THE DRAWINGS

Some preferred exemplary embodiments of the invention will now be described with reference to the accompanying drawings which are given by way of example only, and thus are not intended to limit the present invention.

DETAILED DESCRIPTION OF PREFERRED EMBODIMENTS OF THE 1NVENTION

Figure 1:
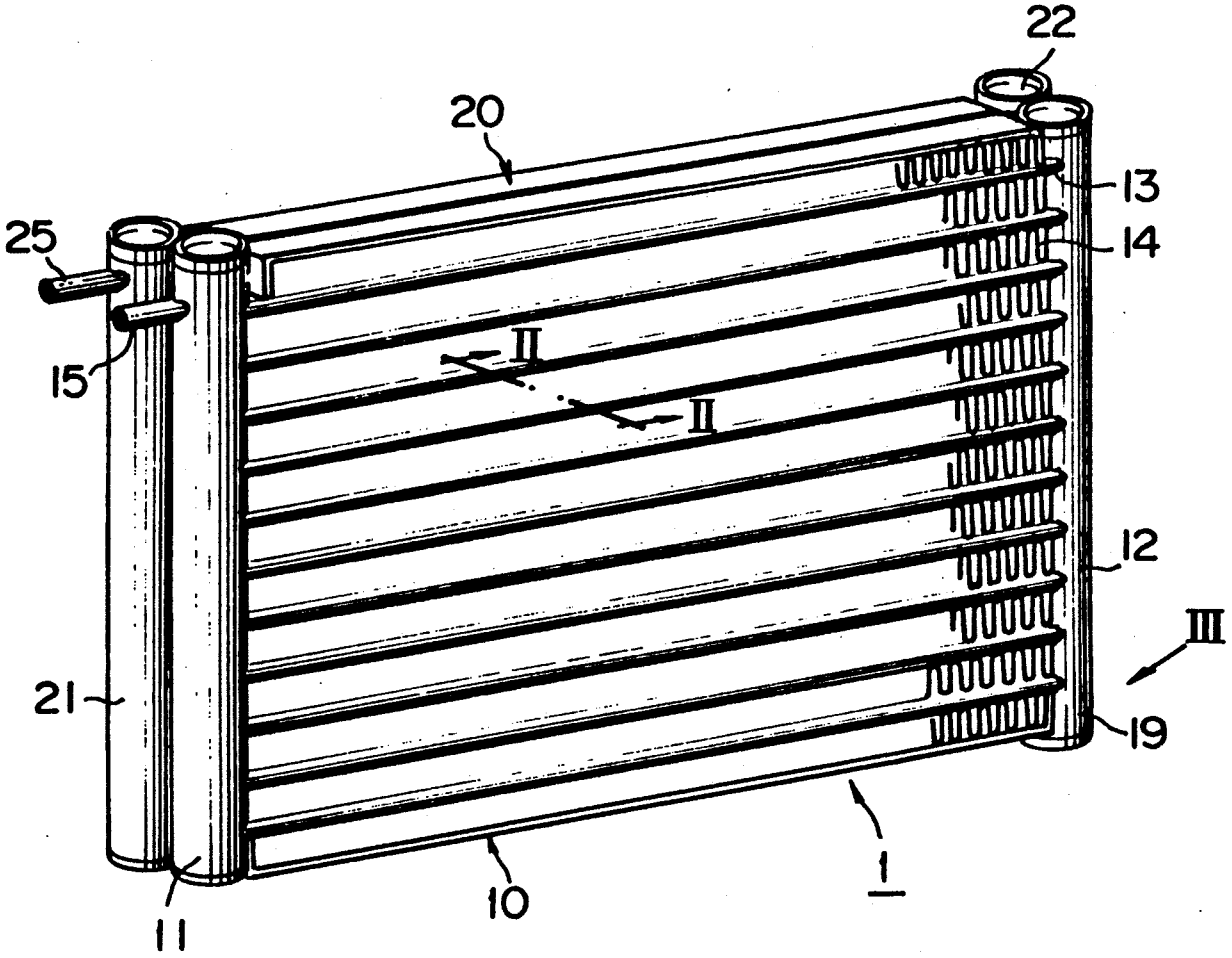
FIG. 1 is a perspective view of a heat exchanger according to a first embodiment of the present invention.
Figure 2:
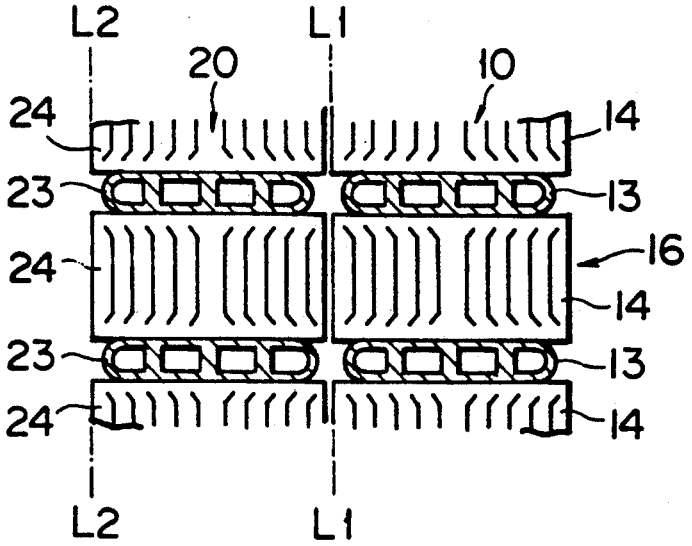
FIG. 2 is an enlarged partial vertical sectional view of the heat exchanger shown in FIG. 1, taken along line II—II of FIG. 1.

Referring to the drawings, FIGS. 1-3 and FIGS. 5 and 6 illustrate a heat exchanger according to a first embodiment of the present invention. In FIGS. 1 and 2, a heat exchanger 1 has two heat-exchanger cores 10 and 20 which are integrally assembled in parallel relation to each other. Front heat-exchanger core 10 comprises a pair of header pipes 11 and 12 extending in parallel relation to each other, a plurality of flat heat-transfer tubes 13 disposed between the header pipes in parallel relation to one another and connected to and communicating with the header pipes at their end portions, a plurality of corrugate type radiation fins 14 provided on the sides of the flat heat-transfer tubes and an inlet tube 15 for a heat medium (in this embodiment, a cooling medium) connected to and communicating with header pipe 11 at its upper side portion. Similarly, rear heat-exchanger core 20 comprises a pair of header pipes 21 and 22, a plurality of flat heat-transfer tubes 23, a plurality of corrugate type radiation fins 24 and an outlet tube 25 for the heat medium connected to and communicating with header pipe 21 at its upper side portion.

In this embodiment, heat-exchanger cores 10 and 20 are substantially the same size (i.e. the same height, the same width and the same thickness), and inlet tube 15 and outlet tube 25 are disposed on the same side of the respective heat-exchanger cores.

Two heat-exchanger cores 10 and 20 are arranged in parallel relation to each other such that a datum plane L1—L1 of heat-exchanger core 10 and a datum plane L2—L2 of heat-exchanger core 20 are parallel to each other. In this embodiment, two heat-exchanger cores 10 and 20 are integrally assembled basically by brazing the portions of the header pipes confronting each other. Each flat heat-transfer tube 13 of heat-exchanger core 10 and each corresponding flat heat-transfer tube 23 of heat-exchanger core 20 are disposed at the same level in height. Additionally, each fin 14 of heat-exchanger core 10 and each corresponding fin 24 of heat-exchanger core 20 are disposed at the same level in height. Therefore, an air path 16 (FIG. 2) for an air flow 17 (FIG. 5) is formed between adjacent flat heat-transfer tubes 13 and between adjacent flat heat-transfer tubes 23 through corrugate radiation fins 14 and 24.

Figure 9:
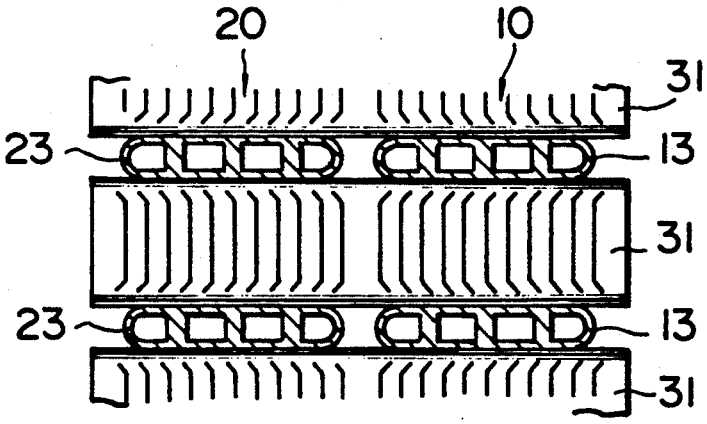
FIG. 9 is a partial vertical sectional view of a heat exchanger according to a modification of the heat exchanger shown in FIG. 2.

The corrugate radiation fins may be constructed as common radiation fins 31 extending between heat-exchanger cores 10 and 20 as shown in FIG. 9. In such a structure, heat-exchanger cores 10 and 20 are more rigidly integrated.

Figure 3:
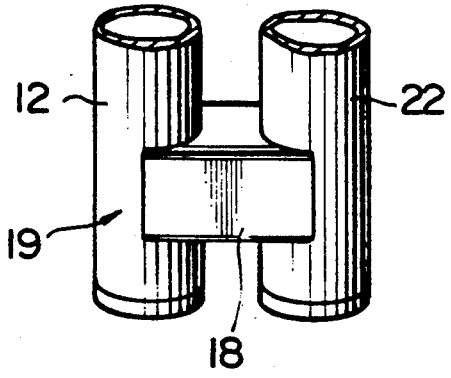
FIG. 3 is an enlarged partial perspective view of the heat exchanger shown in FIG. 1 as viewed from arrow III of FIG. 1.
Figure 4:
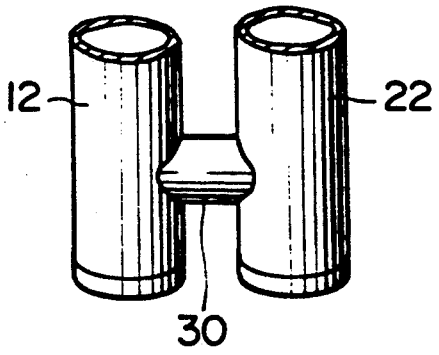
FIG. 4 is a partial perspective view of a heat exchanger according to a modification of the heat exchanger shown in FIG. 1.

Header pipe 12 of heat-exchanger core 10 and header pipe 22 of heat-exchanger core 20 are connected to and communicated with each other by a communication tube 18 at their lower portions as shown in FIG. 3. This communication means may alternatively be constructed of a communication pipe 30 as shown in FIG. 4.

A cooling medium is introduced from inlet tube 15 into header pipe 11, flows in heat-exchanger core 10 through flat heat-transfer tubes 13 in an appropriate serpentine flow between header pipes 11 and 12, and reaches a position 19 of header pipe 12 where communication tube 18 is provided. The cooling medium then flows from header pipe 12 into header pipe 22 through communication tube 18. The cooling medium transferred to heat-exchanger core 20 flows through flat heat-transfer tube 23 in an appropriate serpentine flow between header pipes 21 and 22, reaches the position of outlet tube 25, and flows out from the outlet tube. The cooling medium introduced from inlet tube 15 is gradually condensed during the described passage, and the condensed cooling medium is delivered to other equipment in a refrigerating cycle (not shown). Corrugate radiation fins 14 and 24 accelerate the condensation of the cooling medium. The cooling medium may flow from header pipe 11 to header pipe 12 in a parallel flow through all flat heat-transfer tubes 13. In heat-exchanger core 20, the cooling medium may flow from header pipe 22 to header pipe 21 in a similar parallel flow.

Figure 5:
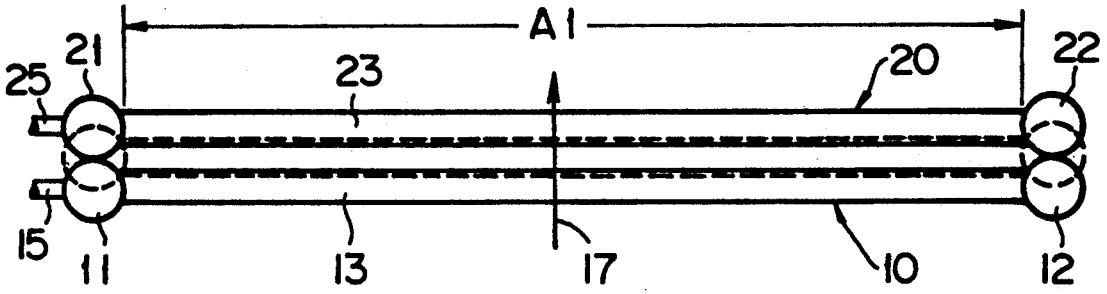
FIG. 5 is a schematic plan view of the heat exchanger shown in FIG. 1.
Figure 15:
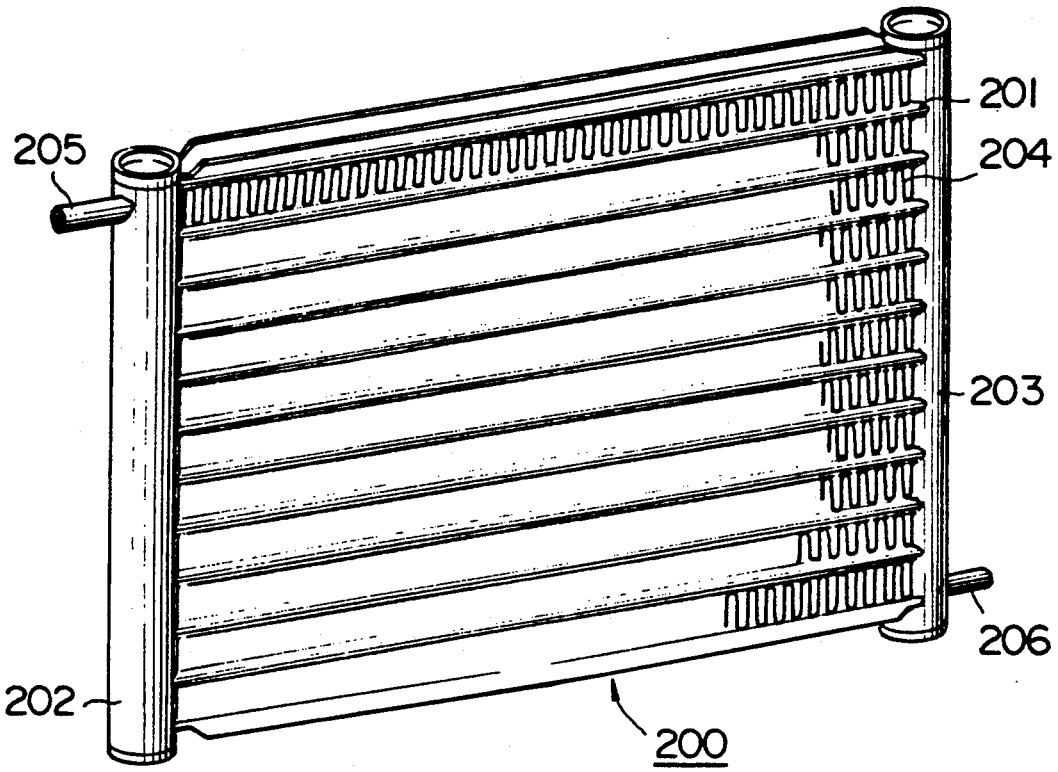
FIG. 15 PRIOR ART
FIG. 15 is a perspective view of another conventional heat exchanger.
Figure 16:
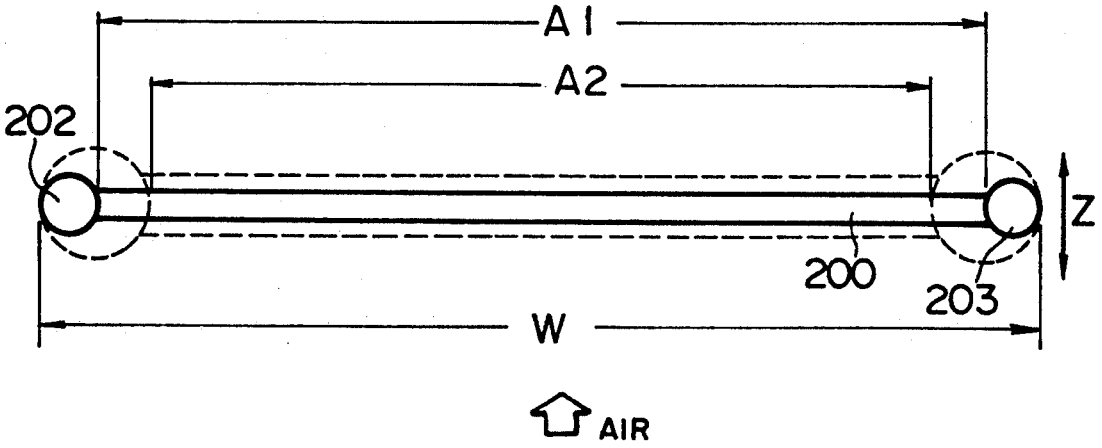
FIG. 16 PRIOR ART
FIG. 16 is a schematic plan view of the heat exchanger shown in FIG. 15.

In such a heat exchanger, as shown in FIG. 5, an air flowable area A1 can have the same width as that of the conventional single heat exchanger shown in FIG. 15 (illustrated by the broken line in FIG. 5), because it is not necessary to increase the diameters of the header pipes in comparison with those of the conventional heat exchanger. Therefore, the air flowable area of heat exchanger 1 can retain a sufficiently large area while the heat-transfer area of the heat exchanger, due to flat heat-transfer tubes 13 and 23, can be increased to an area substantially two times the area of the conventional single heat exchanger. As a result, the total heat-exchange ability of heat exchanger 1 can be increased to a very great extent.

Moreover, in this embodiment, since inlet tube 15 and outlet tube 25 are positioned at the same side of heat exchanger 1 and at the same height, tubes or pipes to be connected to the inlet and outlet tubes can be easily and conveniently connected thereto. Further, the space for the above tubes or pipes around heat exchanger 1 can be greatly saved.

Figure 6:
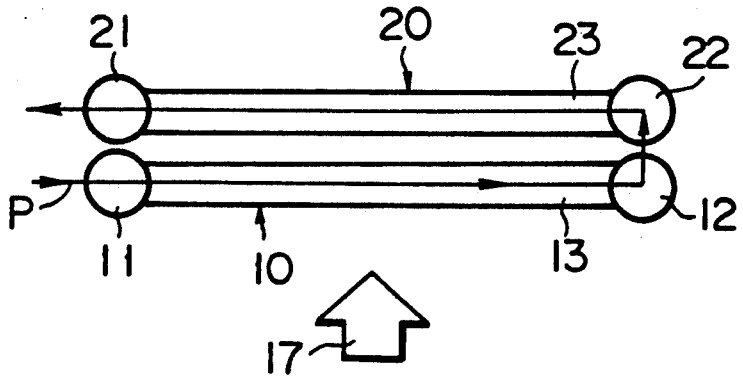
FIG. 6 is a schematic plan view of the heat exchanger shown in FIG. 1 illustrating a flow of a heat medium and an air flow.
Figure 7:
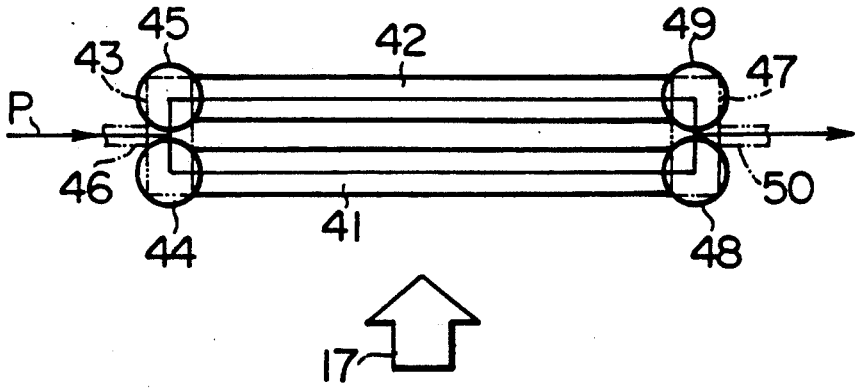
FIG. 7 is a schematic plan view of a heat exchanger according to a second embodiment of the present invention illustrating a flow of a heat medium and an air flow.
Figure 8:
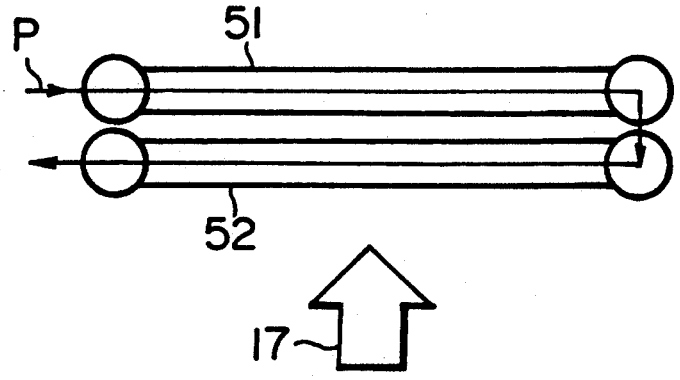
FIG. 8 is a schematic plan view of a heat exchanger according to a third embodiment of the present invention illustrating a flow of a heat medium and an air flow.

Three flows of the cooling medium P can be considered as shown in FIGS. 6–8.

In the above embodiment, the cooling medium flows from front heat-exchanger core 10 to rear heat-exchanger core 20 in accordance with air flow 17 as shown in FIG. 6. In a second embodiment shown in FIG. 7, the cooling medium flows simultaneously in heat-exchanger cores 41 and 42 in a parallel flow. In this embodiment, a header block 43 is provided for connecting and communicating with header pipes 44 and 45. An inlet tube 46 is connected to the header block 43. The introduced cooling medium is distributed to header pipes 44 and 45 by the header block 43. Similarly, a header block 47 is also provided for connecting and communicating with header pipes 48 and 49. An outlet tube 50 is connected to the header block 47. The joined cooling medium in the header block 47 is directed out of the heat exchanger by the outlet tube 50. In a third embodiment shown in FIG. 8, the cooling medium flows from rear heat-exchanger core 51 to front heat-exchanger core 52 in accordance with air flow 17.

In the above three flows of the cooling medium, the radiation ability of the flow shown in FIG. 6 is the highest, followed by the flow shown in FIG. 7. Therefore, the flow of the cooling medium is preferably begun on the upstream side of the air flow. However, the flow shown in FIG. 7 is desirable for limiting pressure loss of the cooling medium flow.

Figure 10:
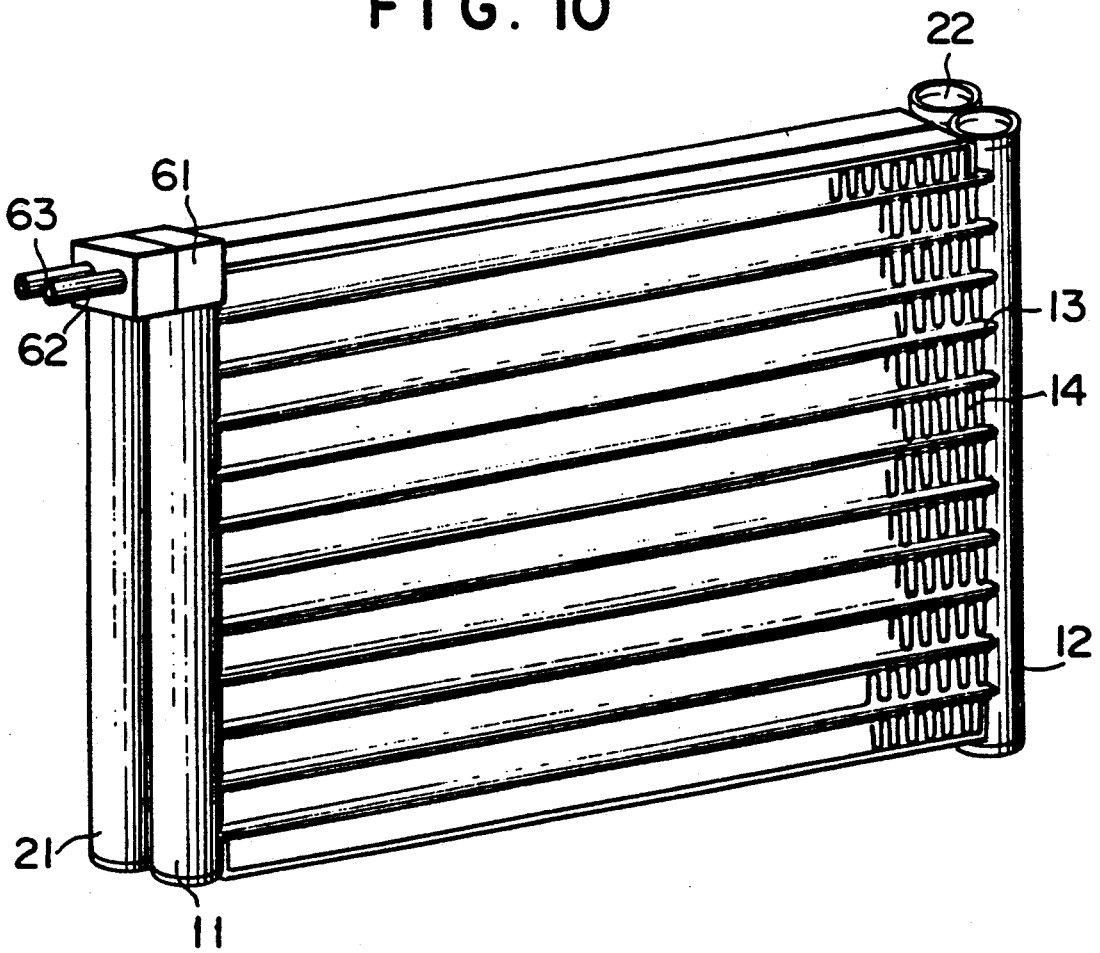
FIG. 10 is a perspective view of a heat exchanger according to a fourth embodiment of the present invention.

In the above flow systems shown in FIGS. 6 and 8, a header block 61 may be applied as shown in FIG. 10 as a fourth embodiment of the present invention. An inlet tube 62 and an outlet tube 63 are both connected to header block 61. The cooling medium introduced from inlet tube 62 flows into header pipe 11 through header block 61 and the condensed cooling medium from header pipe 21 flows out from outlet tube 63 through the header block. The structure of the inlet and outlet portions can thereby be simplified.

Figure 11:
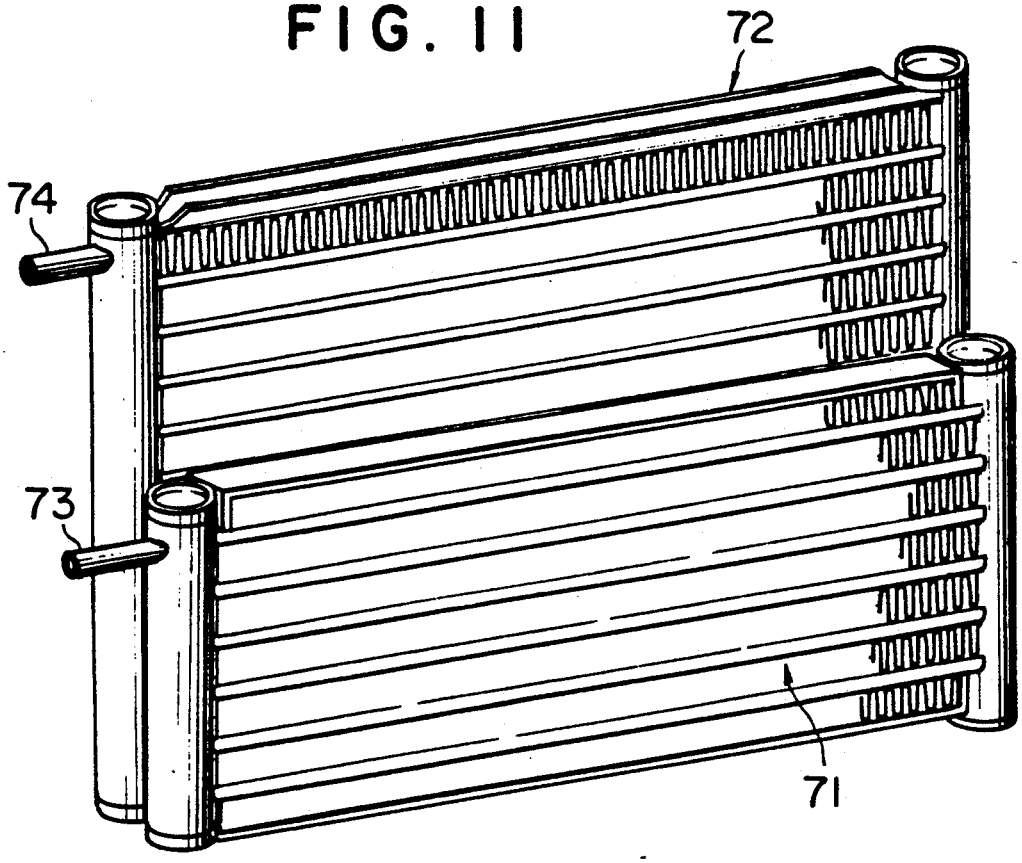
FIG. 11 is perspective view of a heat exchanger according to a fifth embodiment of the present invention.
Figure 14:
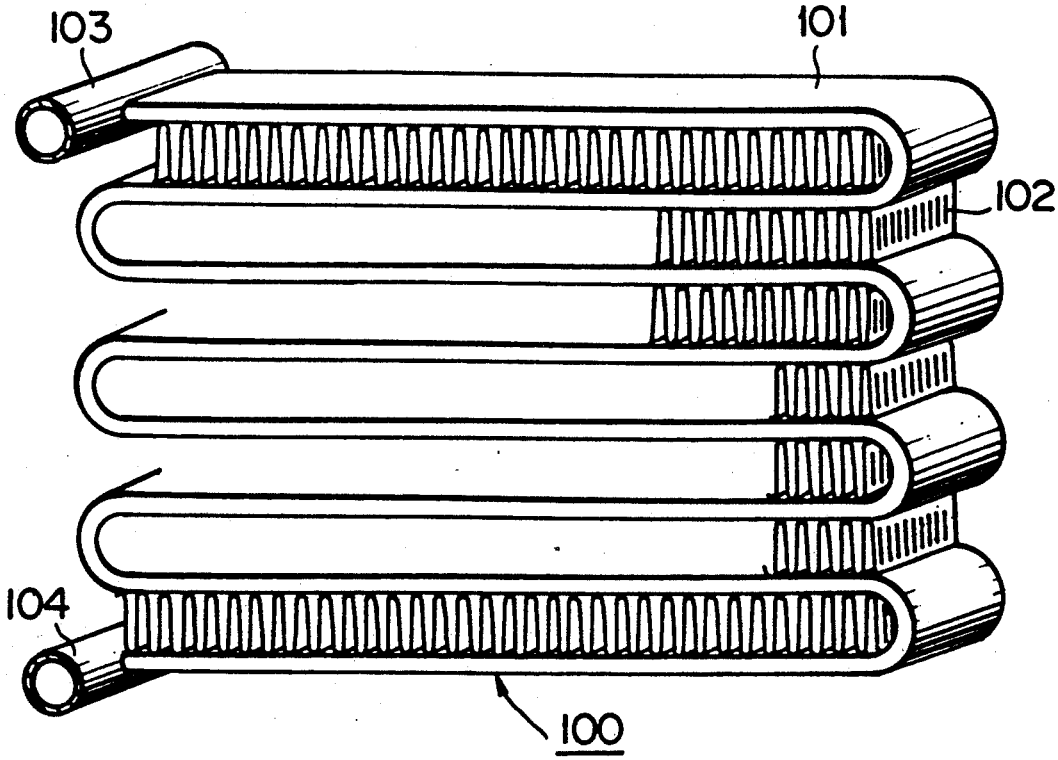
FIG. 14 PRIOR ART
FIG. 14 is a perspective view of a conventional heat exchanger.

FIG. 11 illustrates a fifth embodiment of the present invention. In this embodiment, a front heat-exchanger core 71 is shorter in height than a rear heat-exchanger core 72. An inlet tube 73 is connected to front heat-exchanger core 71 and an outlet tube 74 is connected to rear heat-exchanger core 72. Thus, the integrally assembled heat-exchanger cores can have different heights, and the positions (heights) of inlet tube 73 and outlet tube 74 can be set to adequate positions as needed.

Figure 12:
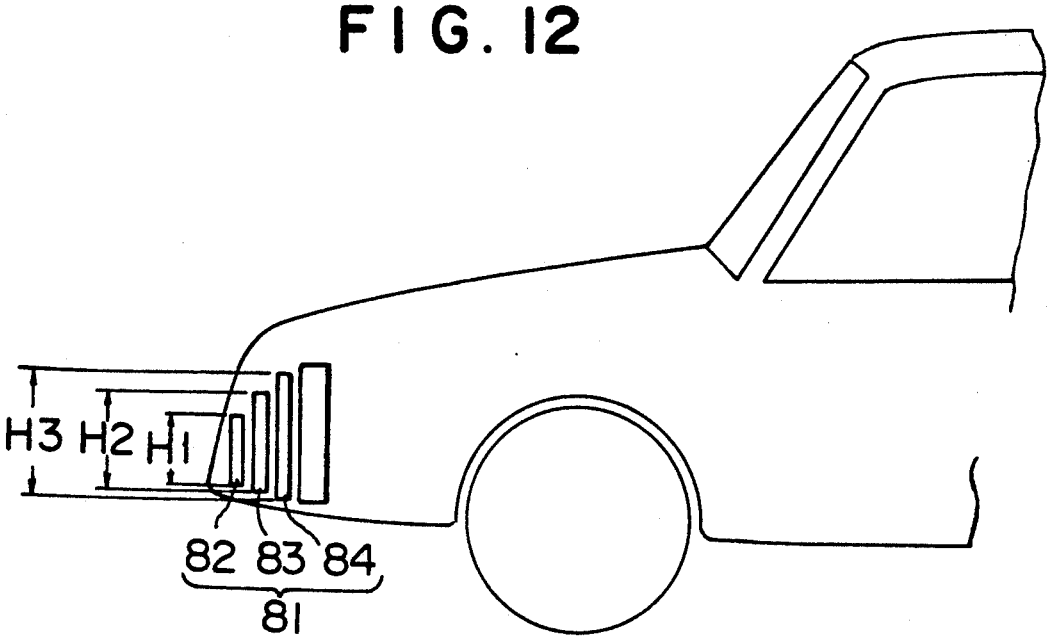
FIG. 12 is a schematic side view of a heat exchanger mounted on an automobile according to a sixth embodiment of the present invention.

Further, the number of heat-exchanger cores integrally assembled as a heat exchanger may be increased. In a sixth embodiment shown in FIG. 12, a heat exchanger 81 is mounted in a front portion of an engine room of an automobile. Heat exchanger 81 comprises three heat-exchanger cores 82, 83 and 84 having respective heights H1, H2 and H3 different from one another. The inside space of the engine room can be efficiently utilized for installation of heat exchanger 81.

Figure 13:
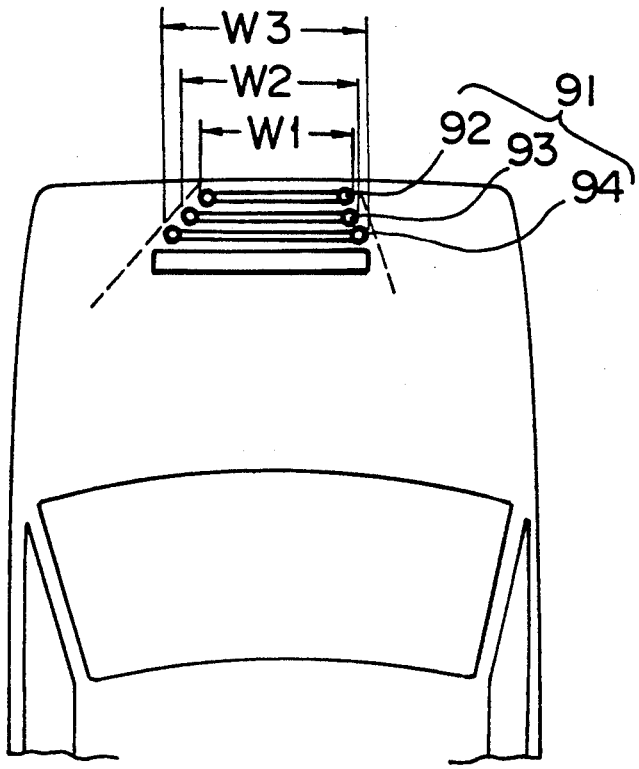
FIG. 13 is a schematic plan view of a heat exchanger mounted on an automobile according to an seventh embodiment of the present invention.

Furthermore, the width of a plurality of heat-exchanger cores constituting a heat exchanger according to the present invention may be changed so that the heat-exchanger cores have different widths relative to one another. FIG. 13 illustrates a seventh embodiment of the present invention. A heat exchanger 91 is mounted in an engine room of an automobile and comprises three heat-exchanger cores 92, 93 and 94 having respective widths W1, W2 and W3 different from one another.

In the above embodiments, the plurality of heat-exchanger cores may be different from one another in height and width. Thus, the heat-exchanger cores constituting a heat exchanger according to the present invention can have different sizes as needed. The positions of the inlet and outlet tubes of the heat exchanger can also be decided to required positions.

Although several preferred embodiments of the present invention have been described herein in detail, it will be appreciated by those skilled in the art that various modifications and alterations can be mode to these embodiments without materially departing from the novel teachings and advantages of this invention. Accordingly, it is to be understood that all such modifications and alterations are included within the scope of the invention as defined by the following claims.

What is claimed is:

1. A method of generating heat exchange in an engine compartment of a vehicle between a heat medium passed through a heat exchanger and a flow of air, said method comprising:

providing a heat exchanger including a plurality of adjacent and generally parallel heat exchanger cores each having a plurality of generally parallel heat transfer passages defining a flow path for said heat medium, at least one of said heat exchanger cores being smaller than at least one other of said heat exchanger cores;

placing said heat exchanger into a space defined in an engine compartment of a vehicle, said space being in a flow path of the air, said placing of said heat exchanger further including positioning said passages of each of said cores to be positioned transversely across said fluid medium flow path; and causing said heat medium to flow through said heat exchanger cores and causing said air to flow along said air flow path, whereby the desired heat exchange is effected.

2. A method in accordance with claim 1 in which said heat medium is caused to initially flow into said at least one smaller heat exchanger core.

3. A method in accordance with claim 2 in which said causing of said heat medium to flow through said heat exchanger cores includes causing said heat medium to flow successively through said adjacent heat exchanger cores.

4. A method in accordance with claim 1 in which said causing of said heat medium to flow through said heat exchanger cores includes causing said heat medium to flow successively through said adjacent heat exchanger cores.

* * * * *